US009719149B2

(12) United States Patent
Moller et al.

(10) Patent No.: US 9,719,149 B2
(45) Date of Patent: Aug. 1, 2017

(54) LOAD TRANSPORT MECHANISM FOR A MULTI-STATION HEAT TREATING SYSTEM

(71) Applicant: IPSEN, INC., Cherry Valley, IL (US)

(72) Inventors: Craig A. Moller, Roscoe, IL (US); Hendrik Grobler, Clyde Park, MT (US); Kevin Woerner, Rockford, IL (US)

(73) Assignee: IPSEN, INC., Cherry Valley, IL (US)

( * ) Notice: Subject to any disclaimer, the term of this patent is extended or adjusted under 35 U.S.C. 154(b) by 564 days.

(21) Appl. No.: 13/723,375

(22) Filed: Dec. 21, 2012

(65) Prior Publication Data

US 2013/0175741 A1 Jul. 11, 2013

Related U.S. Application Data

(60) Provisional application No. 61/579,705, filed on Dec. 23, 2011.

(51) Int. Cl.
*C21D 1/62* (2006.01)
*F27D 3/00* (2006.01)
(Continued)

(52) U.S. Cl.
CPC ..... *C21D 1/62* (2013.01); *C21D 9/0018* (2013.01); *F27B 19/00* (2013.01); *F27D 3/00* (2013.01);
(Continued)

(58) Field of Classification Search
CPC ..... C21D 9/0018; C21D 1/62; F27B 19/00; F27D 3/0024; F27D 3/00; F27D 3/04; F27D 5/0006; F27D 3/02
(Continued)

(56) References Cited

U.S. PATENT DOCUMENTS

| | | | | |
|---|---|---|---|---|
| 4,718,810 | A * | 1/1988 | Hoehn | B23Q 7/1442 104/45 |
| 5,033,927 | A | 7/1991 | Pelissier | |
| 5,549,473 | A * | 8/1996 | Valentian | 432/239 |
| 5,722,825 | A * | 3/1998 | Edenhofer | C21D 1/773 266/251 |
| 6,814,573 | B2 * | 11/2004 | Hiramoto | 432/239 |
| 6,902,635 | B2 * | 6/2005 | Korwin et al. | 148/559 |
| 2001/0050212 | A1 | 12/2001 | Nakatsukasa et al. | |

(Continued)

FOREIGN PATENT DOCUMENTS

| | | | | |
|---|---|---|---|---|
| DE | 4334687 | | 4/1994 | |
| DE | 10359458 | * | 7/2005 | F27D 3/00 |

(Continued)

OTHER PUBLICATIONS

EP Appln. No. 12008527.9, European Extended Search Report, Apr. 25, 2013.

*Primary Examiner* — Scott Kastler
*Assistant Examiner* — Michael Aboagye
(74) *Attorney, Agent, or Firm* — Dann, Dorfman, Herrell and Skillman, P.C.

(57) ABSTRACT

A load transport mechanism for moving a heat treating load in a multi-station heat treating system is disclosed. The transport mechanism has a compact construction that allows it to fit in a centrally located stationary transport chamber. The transport chamber is adapted to provide ready access to multiple treating chambers arrayed around the chamber. The transport mechanism includes a load translation mechanism for moving the load linearly and a load rotation mechanism for rotating the load within the transport chamber. A multi-station heat treating system having a centrally located quenching chamber that includes the load transport mechanism is also disclosed.

7 Claims, 4 Drawing Sheets

(51) Int. Cl.

| | |
|---|---|
| ***C21D 9/00*** | (2006.01) |
| ***F27B 19/00*** | (2006.01) |
| ***F27D 3/02*** | (2006.01) |
| ***F27D 3/04*** | (2006.01) |
| ***F27D 5/00*** | (2006.01) |

(52) U.S. Cl.
CPC ..... *F27D 3/0024* (2013.01); *F27D 3/02* (2013.01); *F27D 3/04* (2013.01); *F27D 5/0006* (2013.01)

(58) Field of Classification Search
USPC .... 266/44, 46, 259, 103, 114; 414/160, 172, 414/117, 166, 152, 147, 149, 154; 432/123, 124, 128, 234, 235, 241, 239, 432/138, 88
See application file for complete search history.

(56) References Cited

U.S. PATENT DOCUMENTS

| | | | |
|---|---|---|---|
| 2002/0146659 | A1 | 10/2002 | Muller-Ziller et al. |
| 2003/0113186 | A1 | 6/2003 | Hiramoto |

FOREIGN PATENT DOCUMENTS

| | | |
|---|---|---|
| FR | 2537260 | 6/1984 |
| JP | 3919875 | 9/1964 |
| JP | H08178535 | 7/1996 |
| JP | 2005009702 | 1/2005 |
| JP | 2007224424 | 9/2007 |
| JP | 2008038182 | 2/2008 |
| JP | 2010266176 | 11/2010 |

* cited by examiner

LOAD TRANSPORT MECHANISM FOR A MULTI-STATION HEAT TREATING SYSTEM

CROSS REFERENCE TO RELATED APPLICATION

This application claims the benefit or U.S. Provisional Application No. 61/579,705, filed Dec. 23, 2012, the entirety of which is incorporated by reference.

BACKGROUND OF THE INVENTION

Field of the Invention

This invention relates generally to heat treating systems for metals and other heat treatable materials and in particular to a multifunction load transport mechanism for loading, unloading, and manipulating a work load.

Background of the Invention

There are known heat treating systems that include multiple treating chambers and a transport module for transporting a work load between the multiple treating chambers. In some of the known systems, the transport module is centrally located relative to the multiple treating chambers. In those systems, the central transport module includes a loading mechanism that is adapted to rotate to any of a plurality of stations that align with a treating chamber. In another known system, the treating chambers are arrayed linearly and the transport module moves linearly on tracks between treating stations. Many of the known loading/unloading mechanisms are configured to lift and carry the load with a fork transfer mechanism. Another known loading/unloading mechanism includes a chain mechanism adapted to push or pull the load between a heating chamber and a quenching chamber.

In most of the multi-station heat treating systems, the quenching chamber is separate and stationary. The centralized transporter mechanism is functionally limited to loading and unloading workloads to and from the several treating chambers, including the quenching chamber. The transport module used in the linearly arrayed system is equipped to maintain the workload under vacuum and at temperature. A separate movable quenching chamber is provided in the linear array system as an alternative transport module. However, the movable quenching chamber is limited to the use of gas quenching. When other types of quenching media are used, the workload must be transported to the quenching chamber that is set up for the desired quenching medium. Moreover, the linear arrangement has the disadvantage of requiring complex connections for power, control, water, and gas.

Another known multi-chamber heat treating system has a centralized quenching chamber that is adapted to rotate and dock with a plurality of treating chambers. That arrangement includes a load transporter in the quenching chamber, but the chamber requires a specialized docking arrangement to permit coupling to the other chambers.

In many of the known heat treating systems, the work load is stationary inside the quenching chamber during a quenching cycle. However, the work loads are not uniform in geometry or density. Therefore, when the load is stationary in the quenching chamber, the load tends to cool nonuniformly. In other words, some parts of the load cool either more slowly or more rapidly because of the static flow patterns of the quenching medium across and through the load. Also known are vacuum heat treating furnaces that include means for rotating the work load inside the furnace either during a heating cycle or during a quenching cycle.

In view of the shortcomings of the known multi-station heat treating systems it would be desirable to have a multipurpose load transport mechanism that is adapted for use in a centrally located quenching chamber. The chamber should be adapted to provide controlled, but easy access to the other treating chambers without complex docking arrangements. Also, the transport mechanism should be adapted for use with multiple quenching media. Further, the transport mechanism should be adapted to rotate the load within the quenching chamber.

SUMMARY OF THE INVENTION

In accordance with a first aspect of the present invention there is provided a load transport mechanism for moving a heat treating load in a multi-station heat treating system. The transport mechanism has a compact construction that allows it to fit in a centrally located stationary transport chamber. The transport chamber is adapted to provide ready access to multiple treating chambers arrayed around the chamber. The transport mechanism includes a load translation mechanism for moving the load linearly and a load rotation mechanism for rotating the load within the transport chamber.

In accordance with another aspect of the present invention, there is provided a multi-station heat treating system having a centrally located quenching chamber. The quenching chamber is adapted to provide relatively easy access to multiple heat treating chambers arrayed around the quenching chamber. The quenching chamber includes an integral transport mechanism that includes a load translation mechanism for moving the load linearly and a load rotation mechanism for rotating the load within the quenching chamber.

In accordance with a further aspect of the present invention there is provided a process for quenching a heated load in a quenching chamber. The process includes the steps of transporting the heated load from a heating chamber into the quenching chamber with a transport mechanism that is installed in the quenching chamber. The process also includes the step of rotating the load during the quenching cycle. The quenching chamber is adapted to utilize a plurality of quenching media so that the process can be practiced with different quenching techniques

BRIEF DESCRIPTION OF THE DRAWINGS

The foregoing summary as well as the following detailed description will be better understood when read with reference to the several views of the drawing, wherein.

DETAILED DESCRIPTION

Figure 1:
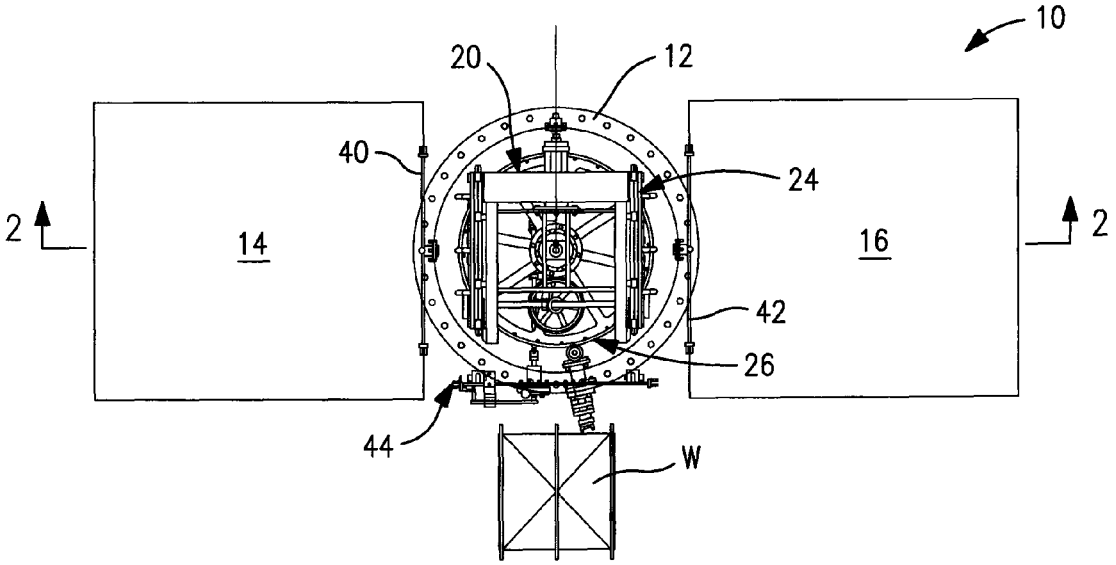
FIG. 1 is a top plan schematic view of a multi-station heat treating system in accordance with the present invention.
Figure 2:
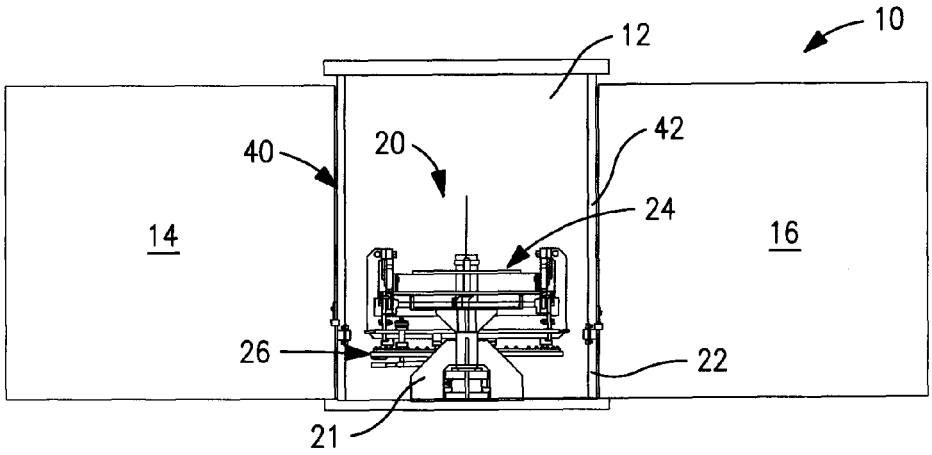
FIG. 2 is cut-away side elevation schematic view of the heat treating system of FIG. 1 as viewed along line 2-2 in FIG. 1.

Referring now to the drawings wherein like reference numerals refer to the same or similar features across the several views, and in particular to FIGS. 1 and 2, there is shown a multi-station heat treating system equipped with a load transport mechanism in accordance with the present invention. The multi-station heat treating system 10 includes a quench chamber 12 that is fixedly positioned between a first treating chamber 14 and a second treating chamber 16. The treating chambers 14 and 16 may be configured as vacuum heating furnaces, atmosphere heating furnaces, carburizing furnaces, or combinations thereof. The quench chamber 12 has ports 40, 42, and 44 located at spaced angular locations about the circumference of the chamber. Ports 40 and 42 are aligned to provide access to heating chambers 14 and 16, respectively. Port 44 is situated so that a work load W can be loaded into the system for processing and unloaded from the system after being processed. A preferred construction for the quenching chamber is described in provisional patent application No. 61/579,058, filed Dec. 22, 2011, the entirety of which is incorporated herein by reference.

A load transport mechanism 20 is located inside the quenching chamber 12. The load transport mechanism 20 is preferably supported on a pedestal 21 that is positioned in the base 22 of the quenching chamber. The load transport mechanism 20 is dimensioned to fit entirely within the interior of quench chamber 12. Load transport mechanism 20 includes a translation mechanism 24 and a rotation mechanism 26. The translation mechanism 24 is constructed and arranged to move the load W laterally so that the load can be loaded into treating chamber 14 or treating chamber 16 and unloaded therefrom. In an additional embodiment, it is contemplated that the translation mechanism can be adapted to move the load vertically in the quenching chamber 12 to provide additional functionality. The rotation mechanism 26 is constructed and arranged to rotate the load W within the quenching chamber 12. The rotation mechanism 26 is preferably adapted to rotate through an angle of 360° or any lesser angle therein and to rotate in either a clockwise or counterclockwise direction.

Figure 3:
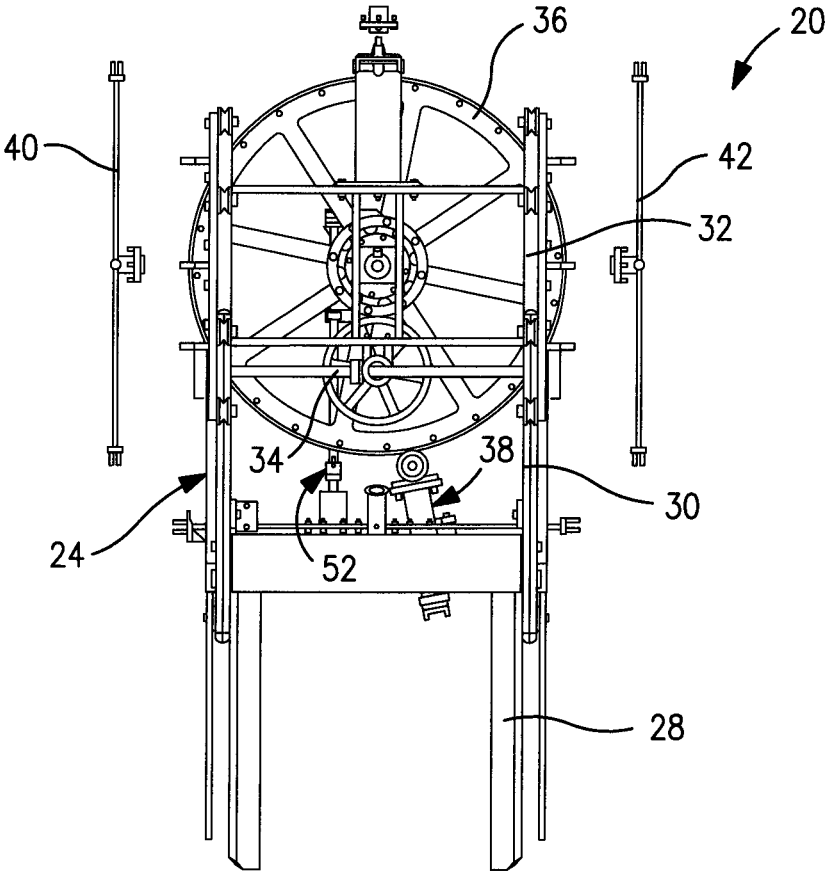
FIG. 3 is top plan view of an embodiment of a load transport mechanism in accordance with the present invention.
Figure 4:
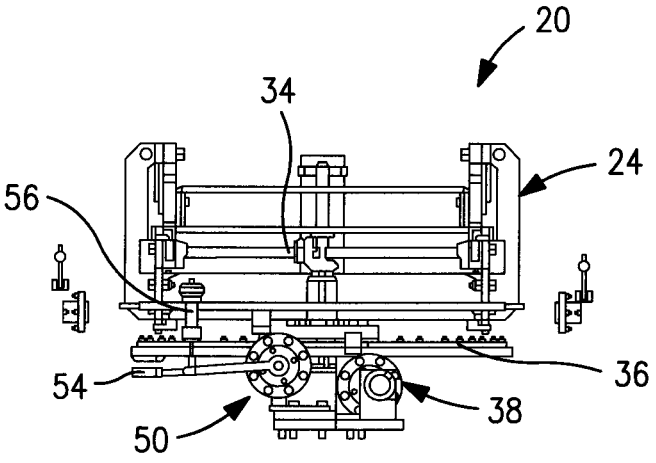
FIG. 4 is a front elevation view of the load transport mechanism of FIG. 3.

Referring now to FIGS. 3 and 4, the load transport mechanism 20 according to this invention is shown in greater detail. The translation mechanism 24 includes means for extending the load into and out of the quenching chamber 12. Preferably, the translation mechanism 24 is configured as a telescoping arrangement. As shown in FIG. 3, the translation mechanism 24 has load support section 28, an intermediate section 30, and a stationary section 32. The load support section 28, intermediate section 30, and stationary section 32 are interconnected so that they can slide relative to each other in a telescoping manner. The load support section 28 is preferably constructed with a pair of parallel beams that are arranged in a fork-like configuration. The fork-like arrangement of the support section facilitates picking up and dropping off a work load. A translation drive mechanism 34 is operably connected to the translation mechanism 24. The translation drive mechanism 34 can be realized by any arrangement within the skill of the art. In the embodiment shown the translation drive mechanism 34 is realized by a gear driven arrangement. However, persons skilled in the art will appreciate that other types of drive mechanisms can be used such as friction drives, chain drives, cable drives, and combinations thereof. The stationary section 32 is attached to the rotation mechanism 26 so that the translation mechanism 24 moves with the rotation mechanism. The translation mechanism 24 is operated by the translation drive mechanism to move between a retracted position, as shown in FIG. 1, and an extended position as shown in FIG. 3.

The rotation mechanism 26 includes a turntable 36 and a rotation drive mechanism 38. The rotation drive mechanism 38 is operably connected to a motive means such as a motor. In the embodiment shown, the turntable 36 has gear teeth around its circumference and the rotation drive mechanism 38 consists of a gear that is driven by an electric motor or other motive means. However, persons skilled in the art will appreciate that other types of rotation drive mechanisms and motive means can be used. The rotation mechanism 26 is operated by the rotation drive mechanism 38 to rotate the turntable 36 through any angle up to 360°. The movement of the rotation mechanism 26 can be indexed so that the load translation mechanism 24 can be rotated to and aligned with one of the respective ports 40, 42, or 44 so that a load W can be loaded into or unloaded from the quench chamber.

In the embodiment shown in FIGS. 3 and 4, the load transport mechanism incorporates a clutch mechanism 50 that can be operated to selectively couple the translation drive mechanism 34 or the rotation drive mechanism 38 to the motive means such as an electric motor. The clutch mechanism 50 includes a linkage 52 and a lever 54 that are operatively connected to each other, to the translation drive mechanism 34, and to the rotation drive mechanism 38. The lever 54 and linkage 52 are constructed and arranged such that when the lever is moved to a first position, the linkage 52 operates to connect only the translation drive mechanism 34 to the motive means. The lever 54 and linkage 52 are also constructed and arranged such that when the lever is moved to a second position, the linkage 52 operates to connect only the rotation drive mechanism 38 to the motive means. The lever 54 may preferably be operated by an actuator 56. The use of the clutch mechanism 50 provides the advantage that the translation drive mechanism and the rotation drive mechanism can be operated with a single motive means. In an alternate embodiment, the translation drive mechanism and the rotation drive mechanism are each driven by a separate motive means so that the clutch mechanism is not required.

The load transport mechanism 20 is constructed with an open structural arrangement that minimizes blockage of quenching media from contacting the load. In this regard, as shown in FIG. 3, the turntable 36 is preferably configured as a wheel having spokes that extend between a hub and a rim portion. Such a construction provides several openings in the turntable. Similarly, the sections of the load translation mechanism 24 are constructed with a minimum number of cross beams to provide as much open area as possible when the load translation mechanism is in the refracted position. The components of the load transport mechanism 20 may be made from a material or materials that can withstand a very high temperature. The components must also be resistant to chemical attack by a liquid quenchant such as oil or water that can be used during a quenching cycle. Moreover, the components of the rotation mechanism, especially the rotation drive mechanism, are selected to be able to operate in any of the quenching media that can be used during a quenching cycle as described more fully below.

Figure 5:
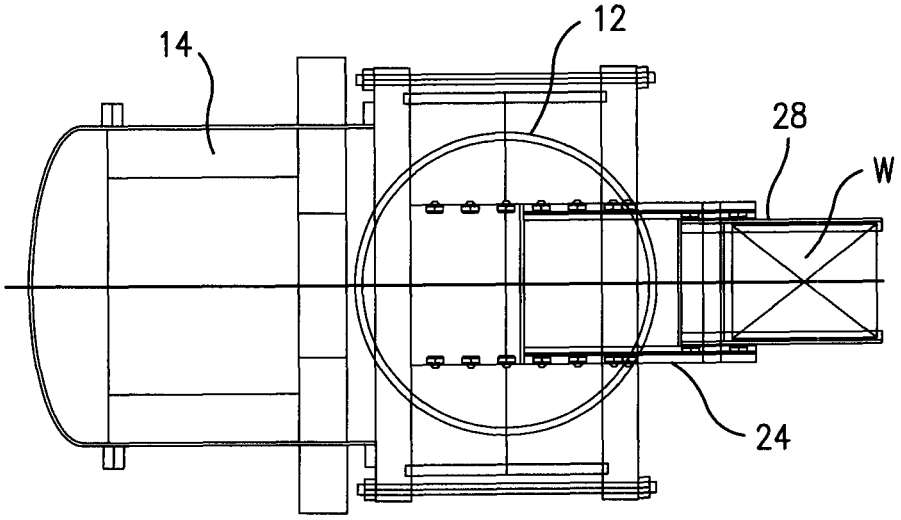
FIG. 5 is a schematic view of a first step in the transporting of a work load with the load transport mechanism of the present invention.
Figure 6:
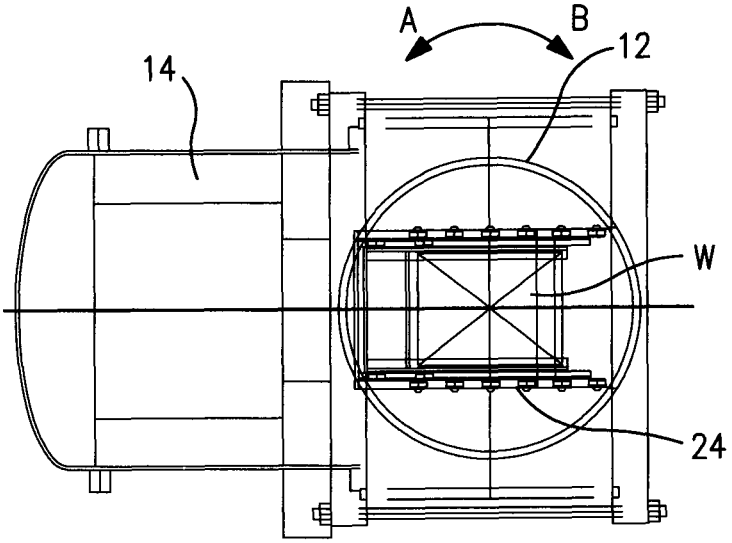
FIG. 6 is a schematic view of a second step in the transporting of the work load of FIG. 5.
Figure 7:
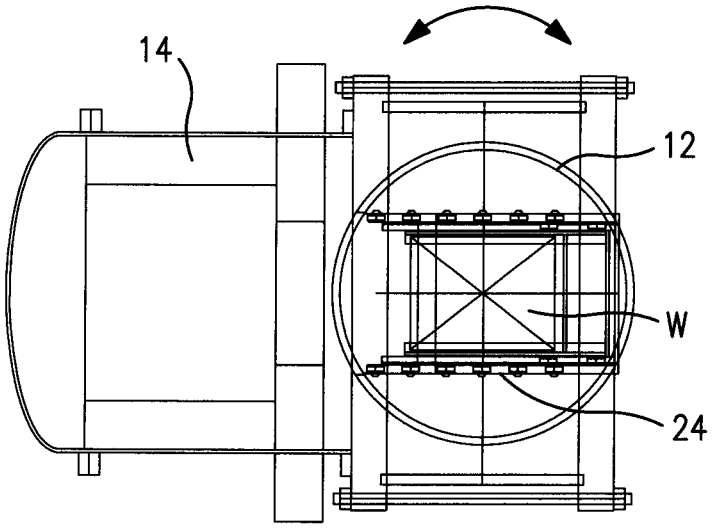
FIG. 7 is a schematic view of a third step in the transporting of the work load of FIG. 5.
Figure 8:
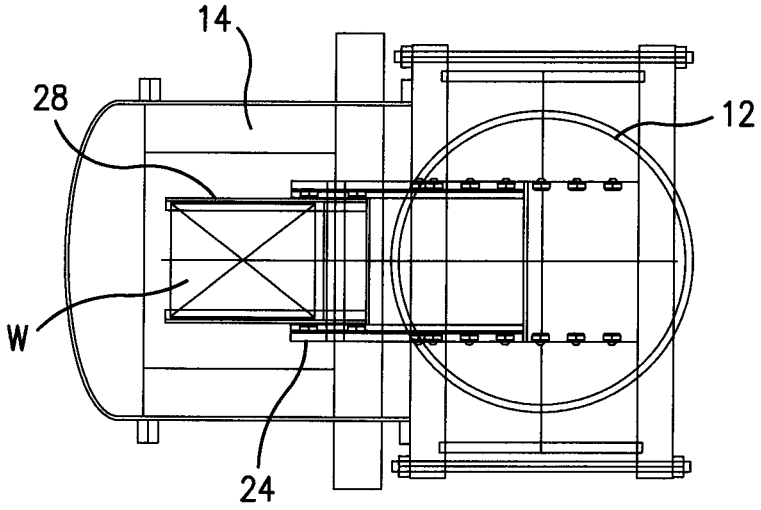
FIG. 8 is a schematic view of a fourth step in the transporting of the work load of FIG. 5.

Referring now to FIGS. 5-8, there are shown various steps in the operation of the load transport mechanism in accordance with the present invention. As shown in FIG. 5 the load translation mechanism 24 is extended out through a port or window in the quenching chamber 12. A work load W is supported on the load support section 28 of the translation mechanism. As shown in FIG. 6, the load translation mechanism 24 is fully refracted such that the load W is entirely contained in the chamber 12. The chamber is then closed and the rotation mechanism is operated to rotate the load W in direction A or B to a first indexed position as shown in FIG. 7. In the first indexed position, the translation mechanism 24 is aligned with a second port that connects to the treating chamber 14. The chamber door is opened and the translation mechanism is then operated to move the load W into the treating chamber 14. The translation mechanism 24 is then retracted back into the quenching chamber. The treating chamber and the quenching chamber are then closed and the load W is processed in the treating chamber. When the process cycle has been completed, the load transfer steps are reversed and the load W is retracted into the quench chamber 12 for quenching or transfer to another treating chamber. Although only two stations are shown in FIGS. 5-8, the ambient loading station and treating chamber 14, it is to be understood that the load transport mechanism according to this invention is design to be rotatable in an indexed manner to any of a plurality of stations arrayed about the chamber 12.

As described in Application No. 61/579,058, the quench chamber 12 is constructed and arranged to perform quenching cycles using a variety of quenching media. Among the quenching media that can be used are gases such as nitrogen, argon, and helium, and liquids such as oil or water. When water is used, it may be applied either in the form of steam or as a mist (fog). It is further contemplated that a cryogenic quenching medium including liquefied inert gases such as liquefied nitrogen can be used. The liquid and cryogenic quench media are preferably flowed through the quench chamber in a top-to-bottom direction, although it will be appreciated by those skilled in the art that the system can be alternatively designed to permit bottom-to-top flow of the quenching medium. Alternatively, the quenchant can be injected from the sides of the quenching chamber by using baffles and/or nozzles. When gas quenching is used, it is preferably used in connection with forced gas recirculation. For liquid quenching, the quenchant can be flooded or sprayed over the work load and in some quenching cycles, the load may be immersed in the liquid quenchant.

During a quenching cycle, the load is supported on the transport mechanism and remains stationary during a quenching cycle. In a preferred process, the load is rotated during the quenching cycle. The purpose of rotating the load during the quench cycle is to improve cooling uniformity throughout the cross section of the load. A rotation drive control system of the load transport mechanism can be programmed in a variety of ways to provide different rotation patterns that are tailored for the load geometry and quenching media used in the quenching cycle. For example, the rotation drive control system can be programmed to effect rotation at a constant speed and in one direction. In another cycle, the rotation drive control system can be programmed to rotate the load with constant speed, but the direction is reversed through two or more angles or after one or more selected time intervals such a periodic intervals. As a further example, the rotation drive control system can be programmed to rotate the load at different speeds for various intervals and to change the direction of rotation at the same or different time intervals. It will be appreciated by those skilled in the art that a large number of combinations of speed and direction can be utilized to provide significant flexibility in achieving uniform cooling of the work load after it has been heat treated.

In view of the foregoing description, some of the advantages provided by the system according to the present invention should now be apparent. For example, a multi-station heat treating system has been described that has a fixed, centrally located quenching chamber which also functions as a module for transporting a work load to and from other stations in the heat treating system, thereby resulting in fewer chambers compared to the known multi-station heat treating systems. The quenching chamber according to this invention includes an integral load transport mechanism that is adapted to rotate within the chamber. The load transport mechanism has a load translation mechanism that supports a work load and which extends and retracts to load and unload the work load from the chamber and to or from another treating chamber or to and external station. Moreover, the retractable construction of the load transport mechanism provides a very compact design when the mechanism is in its fully retracted position. The size of the quenching chamber can thus be reduced compared to the known systems because the load transport mechanism is so compact. The load transport mechanism according to the present invention is constructed from materials that provide full operability in a variety of quenching media that can be used during a quenching cycle.

The integration of the load transport mechanism according to this invention provides additional advantages for operation of the quenching chamber. For example, the load transport mechanism is designed with an open structure that is designed to fully support a work load, but which does not block the quenching media from contacting the work load. Further, the load transport mechanism has a rotation drive system that provides for rotation of the work load for loading/unloading at different positions or during a quench cycle. In a preferred embodiment, the load transport mechanism has a clutch mechanism that is constructed and arranged so that the load translation mechanism and the load rotation mechanism can be operated independently from a single motive means. The control system for the rotation drive mechanism can be programmed to provide a variety of combinations of rotation speeds, angles, and direction changes during a quenching cycle. The indexed and programmed rotation capability of the system according to the present invention provides a significant advancement in the ability to provide uniform cooling of a work load regardless of its geometry or cross section. Moreover, the capability of using various quenching media and techniques in combination with programmed rotation of the work load provides unprecedented flexibility in quenching of heat treated workloads.

The terms and expressions which have been employed are used as terms of description and not of limitation. There is no intention in the use of such terms and expressions of excluding any equivalents of the features or steps shown and described or portions thereof. It is recognized, therefore, that various modifications are possible within the scope and spirit of the invention. Accordingly, the invention incorporates variations that fall within the scope of the invention as described.

The invention claimed is:

1. A load transport apparatus for a multi-station heat treating system comprising:

a load rotation mechanism including a turntable and a rotation drive mechanism operatively connected to said turntable to rotate the turntable, wherein said turntable has a plurality of openings formed therethrough;

a load translation mechanism mounted on said load rotation mechanism, to rotate therewith, said load translation mechanism being configured to move a load laterally so that the load is loaded into or unloaded from a treatment chamber, said load translation mechanism including:

a telescoping structure comprising a stationary section affixed to the turntable, an intermediate section slidably connected to said stationary section, and a forked load support section slidably connected to said intermediate section; and a translation drive mechanism operatively connected to the telescoping structure;

a first motive means connected to said rotation drive mechanism for driving the rotation drive mechanism;

a second motive means connected to the translation drive mechanism for driving the translation drive mechanism; and a pedestal for supporting the load rotation mechanism and the load translation mechanism.

2. A load transport apparatus as claimed in claim 1 wherein the rotation drive mechanism comprises gear teeth formed around the circumference of the turntable and a drive gear connected to the first motive means, wherein the drive gear is engaged with the gear teeth on the turntable.

3. A load transport mechanism as claimed in claim 2 wherein the translation drive mechanism comprises:

a mechanical drive assembly connected to the intermediate section and to the load support section of the telescoping structure, wherein the mechanical drive assembly is selected from the group consisting of a gear drive, a chain drive, a friction drive, a cable drive, or a combination thereof; and a gear mechanism connected between the mechanical drive assembly and the second motive means for actuating the mechanical drive assembly to extend or retract the intermediate section and the load support section when the second motive means is operating.

4. A load transport apparatus as claimed in claim 1 comprising a controller connected to said first motive means, said controller being programmed to operate said first motive means such that the load rotation mechanism can be rotated to an indexed angular position.

5. A load transport apparatus as claimed in claim 4 wherein the controller is also programmed to operate the first motive means such that the load rotation mechanism can be rotated at a constant speed or at different speeds.

6. A load transport apparatus as claimed in claim 4 wherein the controller is also programmed to operate the first motive means such that the load rotation mechanism can be rotated in a single direction or sequentially in a first direction and then a second direction.

7. A load transport apparatus as claimed in claim 1 wherein the turntable comprises a hub, a rim extending around said hub, and a plurality of spokes extending radially from said hub to said rim, such that the plurality of openings are defined between said spokes.

* * * * *